US005375287A

United States Patent [19]

Dillahunt

[11] Patent Number: 5,375,287

[45] Date of Patent: Dec. 27, 1994

[54] SCRUB BRUSH FOR FLAT AND CORNERED SURFACES

[76] Inventor: Joan C. Dillahunt, 6313 Beechwood, Detroit, Mich. 48210

[21] Appl. No.: 150,437

[22] Filed: Nov. 10, 1993

Related U.S. Application Data

[63] Continuation-in-part of Ser. No. 921,034, Jul. 27, 1992, abandoned.

[51] Int. Cl.[5] ..... A46B 5/02; A47L 13/10

[52] U.S. Cl. ..... 15/160; 15/106; 15/143.1

[58] Field of Search ..... 15/106, 143.1, 159.1, 15/160; D4/130, 132, 135; D32/50, 51

[56] References Cited

U.S. PATENT DOCUMENTS

| | | | |
|---|---|---|---|
| D. 25,895 | 8/1896 | Young | D4/130 |
| D. 62,634 | 7/1923 | Van Kriehn | D4/130 |
| 107,397 | 9/1870 | Minderle | 15/159.1 |
| 297,555 | 4/1884 | Baker | 15/159.1 |
| 313,776 | 3/1885 | Sebring | 15/160 |
| 416,330 | 12/1889 | Foster | 15/160 |
| 702,136 | 6/1902 | Isaacs | 15/160 |
| 1,398,864 | 11/1921 | Kelly | 15/143.1 |
| 2,083,134 | 6/1937 | Wood | 15/160 |
| 2,432,264 | 12/1947 | Tyler | 15/159.1 |
| 2,845,644 | 8/1958 | Wisner | 15/159.1 |
| 3,715,772 | 2/1973 | Downing | 15/52.2 |
| 4,005,502 | 2/1977 | Stevens | 15/22.1 |
| 4,343,265 | 8/1982 | Belschner | 15/143.1 |
| 4,360,940 | 11/1982 | Smith | 15/160 |
| 5,267,369 | 12/1993 | O'Neil | 15/160 |

FOREIGN PATENT DOCUMENTS

| | | | |
|---|---|---|---|
| 359325 | 3/1906 | France | 15/160 |
| 467471 | 6/1914 | France | 15/160 |
| 749420 | 5/1933 | France | 15/106 |
| 785434 | 5/1935 | France | 15/160 |
| 1080217 | 5/1954 | France | 15/160 |
| 1229982 | 12/1966 | Germany | 15/160 |
| 4240 | 10/1891 | Switzerland | 15/159.1 |
| 57944 | 12/1911 | Switzerland | 15/160 |
| 9541 | 6/1894 | United Kingdom | 15/160 |
| 12369 | 6/1895 | United Kingdom | 15/160 |
| 416175 | 9/1934 | United Kingdom | 15/143.1 |

*Primary Examiner*—Stephen F. Gerrity
*Assistant Examiner*—Randall E. Chin
*Attorney, Agent, or Firm*—Peter D. Keefe

[57] ABSTRACT

A scrub brush which is structured to be comfortably and controllably held, has a variety of bristles for facilitating scrubbing of variously oriented surfaces, and has a shape which facilitates scrubbing of corners as well as flat and gently curved surfaces. The scrub brush is composed of a body having a main portion of substantially rectangular shape and a nose portion of substantially of triangular shape. The body has a bottom, an opposite top and an edge therebetween. The top is preferably domed for comfortably form fitting into the palm of a user's hand when the user grasps the scrub brush body. The nose portion forms an elongated tip which faces directly away from the main body along a longitudinal axis, and which is elongated along a vertical axis that is oriented perpendicular with respect to the bottom. A ridge is provided on the edge adjacent the top for facilitating a user's fingers and thumb to grasp hold of the scrub brush body. The bottom of the body is provided with a plurality of first bristles oriented substantially perpendicular with respect thereto for providing scrubbing of flat surfaces. The edge of the nose portion is provided with a plurality of second bristles which have varying angles with respect to the bottom for providing scrubbing of corners.

12 Claims, 1 Drawing Sheet

SCRUB BRUSH FOR FLAT AND CORNERED SURFACES

CROSS-REFERENCE TO RELATED APPLICATIONS

The present application is a continuation-in-part of co-pending application Ser. No. 07/921,034, filed Jul. 27, 1992, now abandoned.

BACKGROUND OF THE INVENTION

1. Field of the Invention

The present invention relates to scrub brushes, and more particularly to a scrub brush structured for facilitating scrubbing of flat and cornered surfaces.

2. Description of the Related Art

Conventional scrub brushes are hand-held instruments used for scrubbing flat or gently curved surfaces, such as floors and bath tubs. Conventional scrub brushes are composed of a body having a bottom, an opposite top and an edge defined therebetween. The bottom is provided with a plurality of bristles which are perpendicularly oriented with respect to the bottom. Generally, the bristles are set back from the edge of the body, and the bristles are all uniformly arranged and of uniform length for scrubbing a flat surface beneath the bottom of the body. The top of the body is generally flat and not shaped for comfortable and efficient handling thereof during a scrubbing operation. Some conventional scrub brushes address this handling problem by providing a handle whereby the user grabs hold thereof above the top of the body, and some provide a ridge around the edge adjacent the flat top thereof for providing enhanced gripping. Further, conventional scrub brushes are not structured to allow a user to scrub corners. Even if a conventional scrub brush has a shade other than square or rectangular, such as having a body pointed at one or both ends, conventional scrub brushes only have bristles pointing straight down from the bottom of the body, thus making them ineffective to scrub corners even if they have a pointed front end.

In this regard, it should be noted that corners can be two or three dimensional. A two dimensional corner is defined by the intersection of two mutually perpendicular planes, such as a floor meeting a wall; a three dimensional corner is defined by the intersection of three mutually perpendicular planes, such as a floor meeting with two mutually perpendicular walls.

Accordingly, what is needed in the art is a scrub brush which is structured to be comfortably and controllably held, has a variety of bristles for facilitating scrubbing of variously oriented surfaces, and has a shape which facilitates scrubbing of corners as well as flat and gently curved surfaces.

SUMMARY OF THE INVENTION

The present invention is a scrub brush which is structured to be comfortably and controllably held, has a variety of bristles for facilitating scrubbing of variously oriented surfaces, and has a shape which facilitates scrubbing of corners as well as flat and gently curved surfaces.

The scrub brush according to the present invention is composed of a body having a main portion of substantially rectangular shape and a nose portion of substantially triangular shape, wherein the main and nose portions are preferably integrally formed. The body has a bottom, an opposite top and an edge therebetween. The top is preferably domed for comfortably form fitting into the palm of a user's hand when the user grasps the scrub brush body. The nose portion forms an elongated tip which faces directly away from the main body along a longitudinal axis, and which is elongated along a vertical axis that is oriented perpendicular with respect to the bottom. A ridge is provided on the edge of the main body adjacent the top thereof for facilitating a user's fingers and thumb to grab hold of the scrub brush body.

The bottom of the body is provided with a plurality of first bristles oriented substantially perpendicular with respect thereto, having a bristle arrangement and bristle length for facilitating effective scrubbing of flat and gently curved surfaces. The edge of the nose portion is provided with a plurality of second bristles which have varying angles with respect to the bottom. A first portion of the second bristles is located on the edge of the nose portion, located from adjacent the first bristles at the bottom and extending toward the top. A second portion of the second bristles is arranged in a row along the elongated tip, thereby defining an elongated tip of bristles, wherein the elongation thereof is along the vertical axis.

In operation, the plurality of first bristles provides scrubbing of flat and gently rounded surfaces, while the plurality of second bristles provides scrubbing of cornered surfaces, both of the two and three dimensional kind.

These, and additional objects, advantages, features and benefits of the present invention will become apparent from the following specification.

DETAILED DESCRIPTION OF THE PREFERRED EMBODIMENT

Figure 1:
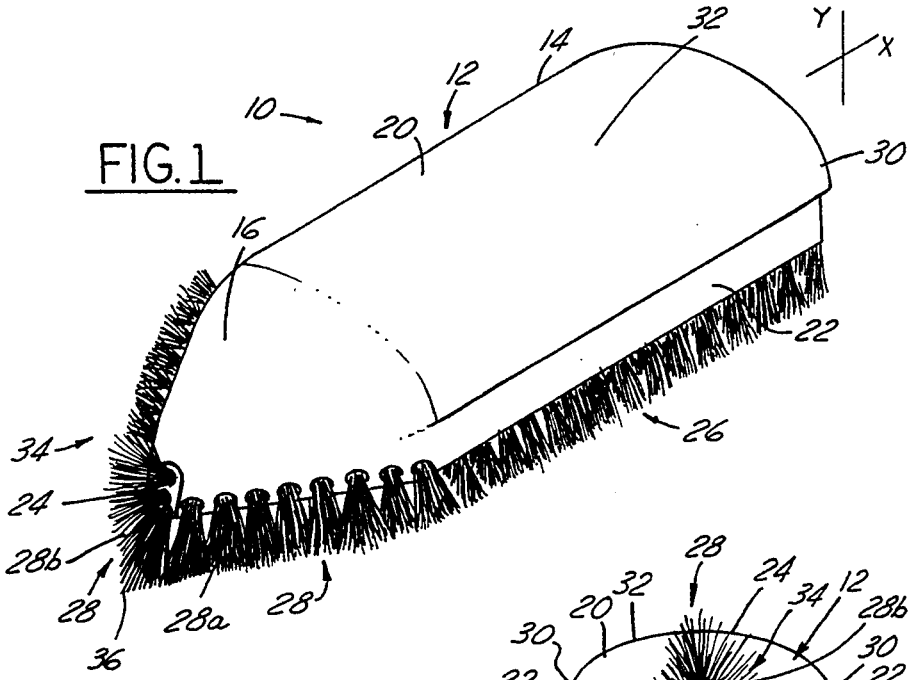
FIG. 1 is a top perspective view of the scrub brush according to the present invention.
Figure 2:
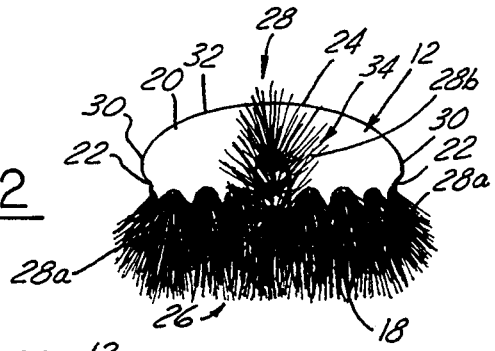
FIG. 2 is a front view of the scrub brush according to the present invention.

Referring now to the Drawing, FIG. 1 depicts the scrub brush 10 according to the present invention. The scrub brush 10 is composed of a body 12, wherein the body has a main portion 14 and a nose portion 16. Preferably, the body 12 is constructed of a single piece of plastic, wood, or other structurally strong, durable, noncorrodible, lightweight material. The interior of the body 12 may or may not be hollow. The body 12 has a bottom 18, an opposite top 20 and an edge 22 that is situated between the top and bottom. The main portion 14 of the body 12 is preferably of a substantially rectangular shape, while the nose portion 16 of the body is of a substantially triangular shape. The nose portion 16 has an elongated tip 24 defining a flat face which faces away from said main portion 14. The bottom 18 of the body 12 is provided with a plurality of first bristles 26 which are selected and arranged for scrubbing a flat or gently curved surface, such as a floor, wall or bath tub. The edge 22 of the body 12 at the nose portion 16 thereof is provided with a plurality of second bristles 28 which are selected and arranged for scrubbing corners of both the two and three dimensional kind.

Figure 3:
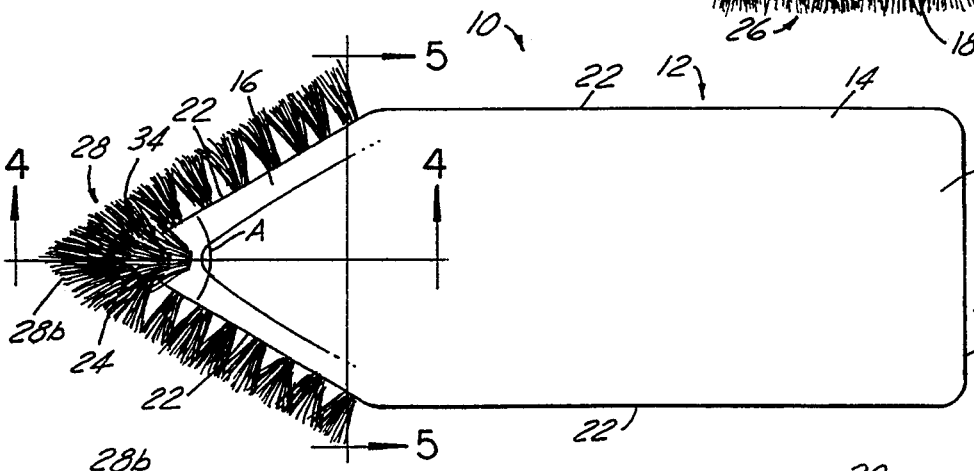
FIG. 3 is a plan view of the scrub brush according to the present invention.
Figure 4:
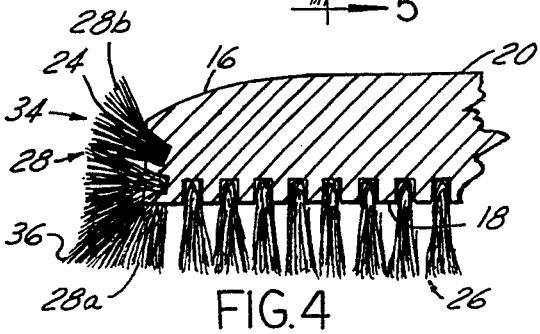
FIG. 4 is a partly sectional side view of the scrub brush according to the present invention, seen along line 4—4 in FIG. 3.
Figure 5:
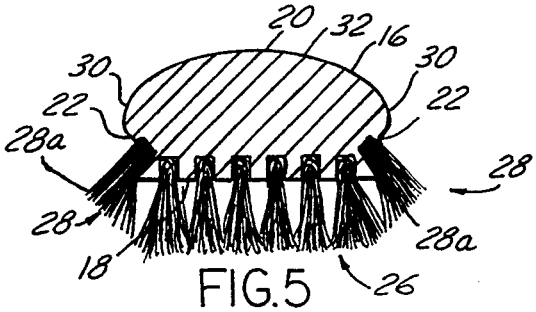
FIG. 5 is a partly sectional front view of the scrub brush according to the present invention, seen along line 5—5 in FIG. 3.

The structure and function of the scrub brush 10 will now be further elaborated with reference being additionally had to FIGS. 3 through 5.

The edge 22 of the body 12 at the main portion 14 thereof is preferably provided with a ridge 30. The ridge 30 is structured to provide a projecting grip location for a user's fingers and thumb when grasping the body 12 from the top 20. Preferably, the edge 22 is oriented perpendicular with respect to the bottom 18 at the main portion 14, and oriented curvably with respect to the bottom at the nose portion 16, neither being a requirement.

The top 20 is preferably shaped to provide an elongated dome 32 which is elongated along the longitudinal axis X (see FIG. 1). The elongated dome 32 is dimensioned to comfortably form fit into the palm of a user's hand. Further, the elongated dome 32 serves to promote liquid run-off during operation of the scrub brush 10, thereby facilitating comfort and control of the scrub brush with respect to a user's hand.

The bottom 18 of the body 12 is preferably flat. The plurality of first bristles 26 are implanted or otherwise attached to the bottom 18 in a conventional manner. The first bristles 26 are preferably composed of scrub brush grade bristles of a type well known in the art, The first bristles 26 are preferably of a preselected length and arrangement on the bottom 18 so as to provide an excellent scrubbing function with respect to a flat or gently curved surface. The first plurality of bristles 26 extends across the bottom 18 inclusive of the main and nose portions 14, 16 of the body 12.

The substantially triangular shape of the nose portion 16 provides the aforementioned elongated tip 24. The elongation of the elongated tip 24 is along the vertical axis Y (see FIG. 1). The triangular shape of the nose portion 16 is defined by a taper angle A of the edges 22 at the nose portion as measured in a plane parallel with respect to the bottom 18 not exceeding ninety degrees, and preferably at an angle of substantially around forty-five degrees in order to facilitate fitting of the nose portion 16 along with its associated plurality of second bristles 28 into three dimensional corners with ease of clearance.

The plurality of second bristles 28 are arranged on the edge 22 of the body 12 at the nose portion 16 and attached thereto by implantation or any other conventional manner of attachment. A first portion **28*a* of the second bristles 28 is located on the edge 22, the first portion extending from the bottom 18 toward the top 20. Preferably in this respect, the first portion 28*a* of the second bristles 28 are located on the nose portion 16 from the bottom adjacent the first bristles 26 to a preselected location on the edge somewhat near the top. Further in this respect, the first portion 28*a* of second bristles 28 project radially from the nose portion 16 with varying angles with respect to the bottom, varying from preferably substantially perpendicular to the bottom to preferably substantially forty degrees with respect to the bottom. A second portion 28*b* of the second bristles 28 is located at the elongated tip 24, thereby forming the aforementioned elongated bristle tip 34, which elongated tip is elongated in a direction parallel with respect to the vertical axis Y. Preferably, the elongated bristle tip 34 is characterized by the second portion 28*b* of the second bristles 28 radiating outwardly from the elongated tip 24, in a row oriented generally parallel to the plane formed by the intersection of the longitudinal and vertical axes X, Y and ranging from the bottom 18 to the top 20. Preferably, the bristle tip 34 includes a bristle point 36 located adjacent a plane formed by the terminus of the first bristles 26. The bristle point 36** permits a user to probe and clean three dimensional corners with effective ease.

In operation, the user grasps the body at the top 20 by gripping the ridge 30 with his or her fingers and thumb. The user uses the first bristles 26 to scrub flat or gently curved surfaces. The user also uses the first portion **28*a* of second bristles 28 to scrub two dimensional corners, such as a floor meeting a wall. The user still further uses the second portion 28*b* of the second bristles (along with, ordinarily, a portion of the first portion of bristles located near the elongated tip 24**) to scrub three dimensional corners, such as a floor meeting two mutually perpendicular walls.

The body 12 may be characterized by various combinations of lengths, widths and thicknesses. The main portion 14 of the body 12 may be provided in other than a rectangular shape, such as round, square or oval. The bristles composing the first and second bristles 26, 28 may be of any selected composition, texture, size, shape, and may or may not be arranged in discrete bundles (as shown in the Drawing). The bristles may be of varying lengths, of varying compositions and at varying angles with respect to the body. It is preferred for the nose portion 16 to be about one-third the length (along the longitudinal axis X) of the length of the main portion 14. The first and second portions **28*a*, 28*b* of the second bristles 28 may be composed of mutually different kinds of bristles, the same kind of bristles, or some mixture thereof. It is also to be noted that the orientation, distribution and selection of the second bristles 28** is preferably such as to permit simultaneous scrubbing of two or more intersecting surfaces of any relative angular relationship.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A scrub brush for being hand held by a user for scrubbing surfaces inclusive of corners, comprising:

an elongated body, said body having a bottom and a top opposite said bottom, said body having a longitudinal axis oriented parallel with respect to said bottom and a vertical axis oriented perpendicular to said longitudinal axis, said body comprising:

a main portion having a predetermined shape for being grasped by a hand of a user;

a nose portion connected with said main portion at one end thereof, said main portion and nose portion delimited by linear edges extending about the periphery of said body and between said top and bottom, said nose portion being triangularly shaped in a first plane parallel with respect to said bottom, the triangular shape of said nose portion being defined by said edges at said nose portion tapering from said edges at said main portion to an elongated tip remote from said main portion, said tapering of said edges at said nose portion being defined by an angle as measured at said elongated tip in said first plane, said angle ranging from substantially forty-five degrees to ninety degrees, said elongated tip defining a flat face facing away from said main portion, said elongated tip being elongated between said bottom and said top in a direction substantially parallel with respect to said vertical axis;

a plurality of first bristles connected to said bottom, said plurality of first bristles projecting an equal predetermined distance from said bottom; and a plurality of second bristles connected to said nose portion, said plurality of second bristles comprising:

a first portion of said plurality of second bristles located between a first location substantially adjacent said bottom and a predetermined location between said bottom and said top, said first portion of said plurality of second bristles having a plurality of orientations with respect to said bottom; said first portion of said plurality of second bristles being arranged in a shape substantially similar with respect to the triangular shape of said nose portion when viewed in plan; and a second portion of said plurality of second bristles located at said elongated tip, said second portion of said plurality of second bristles being arranged substantially in a row oriented substantially parallel to the vertical axis, said second portion of said plurality of second bristles forming a bristle tip, said bristle tip having a bristle point located substantially in a second plane parallel to said bottom at said predetermined distance therefrom.

2. The scrub brush of claim 1, wherein said top has a dome shape which is elongated along said longitudinal axis.

3. The scrub brush of claim 2, further comprising a ridge located on said edges at said main portion of said body at a location substantially adjacent said top for facilitating a user to grip said body.

4. The scrub brush of claim 3, wherein said plurality of orientations of said first portion of said second bristles ranges from substantially ninety degrees to substantially forty degrees with respect to said bottom.

5. The scrub brush of claim 4, wherein said bottom is substantially flat; further wherein said first bristles are preselected and arranged on said bottom in a predetermined pattern to provide scrubbing of a first surface, wherein said first surface being selected from a group of surfaces that include flat and gently curved surfaces.

6. The scrub brush of claim 5, wherein said first portion of said second bristles are preselected and arranged at said edges of said nose portion in a predetermined pattern to provide simultaneous scrubbing of each surface that mutually form a two dimensional corner.

7. The scrub brush of claim 5, wherein said second portion of said second bristles are preselected and arranged in a predetermined pattern to provide simultaneous scrubbing of each surface that mutually form a corner.

8. The scrub brush of claim 5, wherein said first and second portions of said second bristles are preselected and arranged in a predetermined pattern to provide simultaneous scrubbing of each surface that mutually form a three dimensional corner.

9. The scrub brush of claim 1, wherein said angle is less than ninety degrees.

10. The scrub brush of claim 1, wherein said bottom is substantially flat; further wherein said first bristles are preselected and arranged on said bottom in a predetermined pattern to provide scrubbing of a first surface, wherein said first surface being selected from a group of surfaces that include flat and gently curved surfaces.

11. The scrub brush of claim 10, wherein said first portion of said second bristles are preselected and arranged at said edges of said nose portion in a predetermined pattern to provide simultaneous scrubbing of each surface that mutually form a two dimensional corner.

12. The scrub brush of claim 11, wherein said second portion of said second bristles are preselected and arranged in a predetermined pattern to provide simultaneous scrubbing of each surface that mutually form a corner.

* * * * *